United States Patent [19]

Iwans

[11] 4,376,314

[45] Mar. 15, 1983

[54] VEHICULAR TOILET

[75] Inventor: Robert C. Iwans, Simsbury, Conn.

[73] Assignee: Kidde, Inc., Belleville, N.J.

[21] Appl. No.: 273,189

[22] Filed: Jun. 12, 1981

[51] Int. Cl.[3] ..... E03D 11/00; B60R 15/04

[52] U.S. Cl. ..... 4/431; 4/420; 4/435; 4/458

[58] Field of Search ..... 4/300, 316, 321, 323, 4/328, 329, 332, 347, 348, 352, 420–420.5, 431–434, 443–448, 661

[56] References Cited

U.S. PATENT DOCUMENTS

| | | | |
|---|---|---|---|
| 3,805,304 | 4/1974 | Ikehata | 4/352 |
| 3,986,216 | 10/1976 | Davis et al. | 4/432 |
| 4,041,554 | 8/1977 | Gregory et al. | 4/420 |
| 4,275,470 | 6/1981 | Badger et al. | 4/431 |
| 4,306,321 | 12/1981 | Norlin | 4/431 |

*Primary Examiner*—Stephen Marcus
*Assistant Examiner*—Kenneth S. Putnam
*Attorney, Agent, or Firm*—Lyon & Lyon

[57] ABSTRACT

A vehicular toilet comprising a toilet bowl having an upper rim defining a bowl opening and a lower outlet, a flush valve for selectively controlling the application of a vacuum to the bowl outlet for flushing the toilet, a flush ring proximate the toilet bowl rim having apertures for directing liquid downwardly onto the surface of the bowl during flushing, means for increasing the cleaning effectiveness of the liquid as it flows downwardly over the toilet bowl during flushing including means for sealing the toilet bowl opening, a manifold having air inlet apertures and air outlet apertures communicating with the interior of the toilet bowl above the flush ring, and a baffle for directing the air pulled into the bowl from the air manifold during flushing downwardly over the liquid discharged from the flush ring.

6 Claims, 2 Drawing Figures

VEHICULAR TOILET

Figure 2:
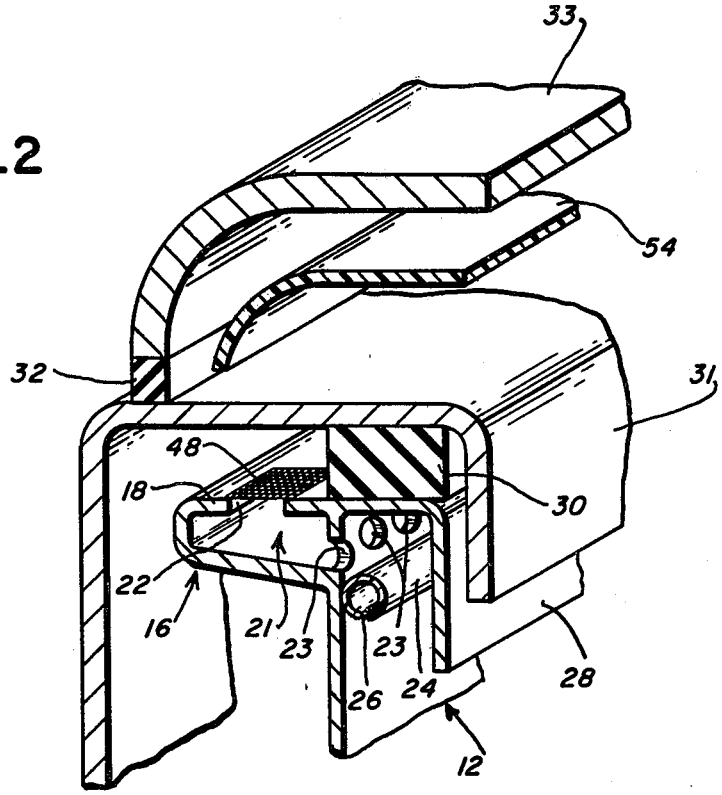

The present invention relates to vehicular toilets which are to be flushed with a limited volume of fresh liquid.

Since the volume of flushing liquid which must be carried for use with a vehicular toilet is directly related to the volume of liquid required for each flush of the toilet it is very desirable to minimize the volume of liquid utilized for each flush. The volume of liquid utilized for each flush must, however, effectively maintain the cleanliness of the toilet.

It is accordingly an object of the present invention to provide a vehicular toilet which employs an amount of flushing liquid in its flushing cycle which would not be sufficient in a conventional system to maintain the toilet in a clean condition whereby the weight of the system can be reduced.

Other objects and advantages of the present invention will become apparent from the following portion of the specification and from the accompanying drawings which illustrate, in accordance with the mandate of the patent statutes, a presently preferred embodiment incorporating the principles of the invention.

Figure 1:
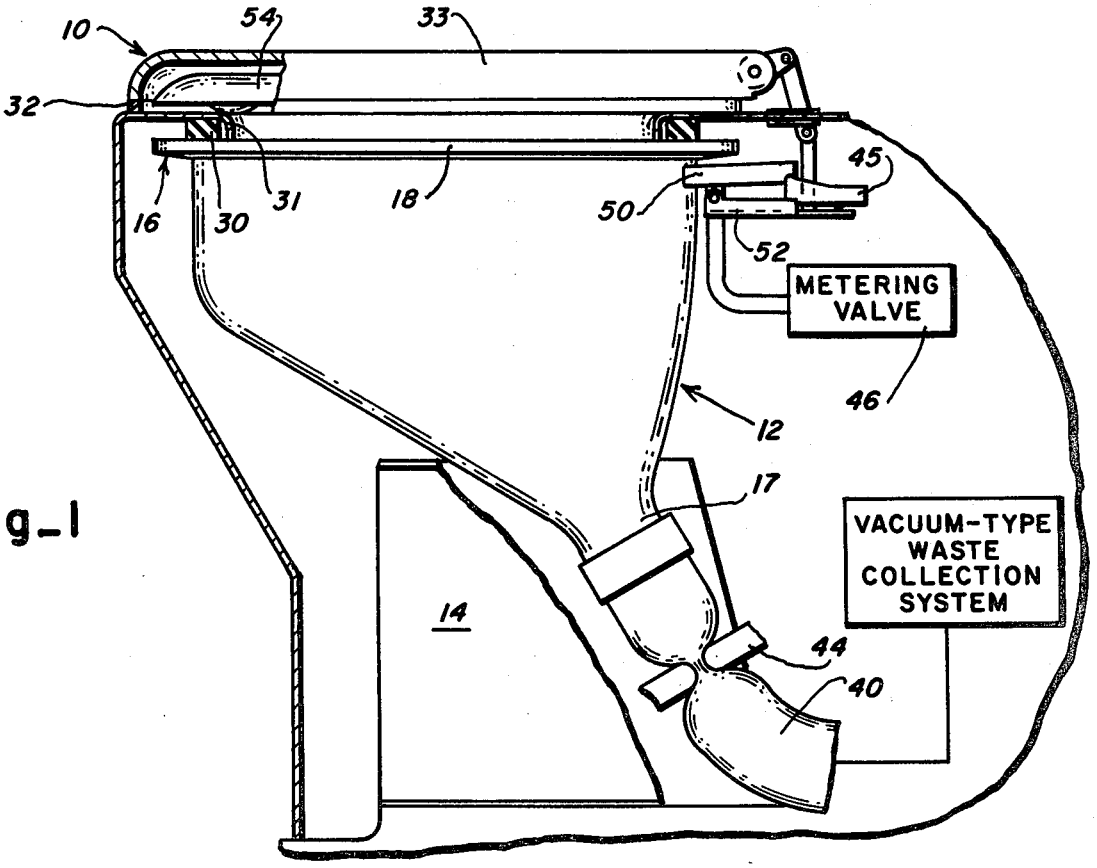

Referring to the drawings:

FIG. 1 is a side view partially sectioned of a toilet made in accordance with the teachings of the present invention; and FIG. 2 is a partial perspective view of the rim of the toilet of FIG. 1.

The toilet 10 includes a toilet bowl 12 mounted on a base 14. The toilet bowl 12 includes an upper rim 16 defining a bowl opening and a lower outlet 17. The rim (FIG. 2) has an outwardly projecting first portion 18 in the form of a C-shaped annular channel integral with the outer surface of the bowl 12 defining a manifold 21. A first series of intake apertures 22 are defined in the top surface of the manifold 21 and a second series of exhaust apertures 23 are defined in the bowl portion of the manifold. A flush ring 24 having a plurality of spaced downwardly opening apertures 26 is mounted on the inner surface of the bowl 12 below the second series of manifold apertures 23 and an inwardly protruding second rim portion 28 integral with the first portion defines an annular baffle extending inwardly above the second series of apertures a short distance from the inner surface of the bowl 12 and downwardly substantially parallel to the bowl surface to a location below the flush ring 24.

A first annular seal 30 located between the baffle 28 and the inner surface of the toilet shroud 31 and a second annular seal 32 located between the toilet cover 33 and the upper surface of the shroud 31 effectively seal the toilet bowl opening when the cover or lid 33 is closed. A normally closed pinch valve 44 selectively opens a discharge conduit 40 which leads from the bowl outlet 17 to a vacuum-type waste collection system.

To flush the toilet, the lid 33 is closed sealing the bowl opening and energizing control switch 45. A diaphragm-type metering valve 46 is thereby activated injecting a metered volume of water (about 8 ounces) into the bowl 12 through the flush ring. Conjointly therewith the pinch valve 44 is opened and a vacuum is applied to the toilet pulling air into the toilet bowl through the air manifold 21. This air, which moves rapidly due to the size of the manifold openings, is deflected downwardly by the baffle 28 over the flush ring 24.

The air is thus forced to accomplish several functions which enhance the cleaning effectiveness of the flush liquid. It acts as a curtain over the flush water spray pattern to help suppress misting. It impacts the jets of flush water increasing its velocity and causing the water to disperse and provide uniform bowl wetting. The air also washes down all sides of the bowl with a vigorous air flow, lifting both wet and dry materials off the bowl surface, moving them effectively into the restricted neck 17 of the bowl 12. At this point, the waste material is subject to the full motive force of the pressure differential and is moved quickly and easily through the pinch valve 44 and on into the waste tank. The flow of air will also function to maintain the toilet in a substantially clean condition in the event the supply of flushing liquid is used up.

Screens 48 may be provided for the inlet openings 22 of the air manifold 21. Additionally, a normally opened toilet bowl vent 50, which is closed by a sealing cover 52 when the lid 33 is closed, prevents someone from becoming stuck to the seat 54 in the event that the flush valve should accidently open.

What is claimed is:

1. A vehicular toilet comprising
   - a toilet bowl having an upper rim defining a bowl opening and a lower outlet,
   - means for selectively controlling the application of a vacuum to said bowl outlet for flushing the toilet,
   - flush ring means proximate said toilet bowl rim having aperture means for directing liquid downwardly onto the inner surface of said bowl during flushing,
   - means for increasing the cleaning effectiveness of the liquid as it flows downwardly over the toilet bowl during flushing including
   - means for sealing said toilet bowl opening,
   - manifold means having air inlet aperture means and air outlet aperture means communicating with the interior of said toilet bowl above said flush ring means, and
   - means for directing the air pulled into said bowl from said air manifold during flushing downwardly over the liquid discharged from said flush ring means.

2. A vehicular toilet according to claim 1 wherein said outlet aperture means are selectively sized so that the velocity of air pulled therethrough will be greater than the velocity of the liquid flowing down the bowl surface for increasing the velocity thereof.

3. A vehicular toilet according to claim 1 or 2 wherein said sealing means includes a toilet lid having an open position and a closed sealing position.

4. A vehicular toilet according to claim 1 or 2 wherein said rim comprises said manifold means and said air directing means.

5. A vehicular toilet according to claim 1 or 2 additionally comprising metering means for injecting a selected volume of flush liquid into said bowl through said flush ring during flushing.

6. A vehicular toilet according to claim 5 wherein said selected volume of flush liquid is not greater than 8 ounces per flush.

* * * * *